United States Patent [19]

Kinney

[11] 4,231,602

[45] Nov. 4, 1980

[54] REFUSE COLLECTION DEVICE

[76] Inventor: Frank N. Kinney, 300 Fountain Ave., Ellwood City, Pa. 16117

[21] Appl. No.: 946,540

[22] Filed: Sep. 28, 1978

[51] Int. Cl.[3] ..... A01K 29/00

[52] U.S. Cl. ..... 294/1 BA

[58] Field of Search ..... 294/1 R, 19 R, 55; 15/104.8, 257.1, 257.4, 257.6, 257.7; 119/1; 141/108, 390; 248/95, 97, 99, 100, 101

[56] References Cited

U.S. PATENT DOCUMENTS

| | | | |
|---|---|---|---|
| 3,052,214 | 9/1962 | Johnson | 15/257.6 X |
| 3,281,178 | 10/1966 | Fisher | 294/55 X |
| 3,733,099 | 5/1973 | Szita | 294/19 R X |
| 3,754,785 | 8/1973 | Anderson | 294/55 X |
| 3,810,670 | 5/1974 | Turi | 294/19 R |

*Primary Examiner*—Johnny D. Cherry

*Attorney, Agent, or Firm*—Webster B. Harpman

[57] ABSTRACT

A refuse collection device has an elongated handle with a sleeve slidable thereon and wire frames on the handle and sleeve respectively for engagement in the open end of a disposable bag. Movement of the handle relative to the sleeve expands the bag to a full open position and secures it whereupon the bag may be turned inside out by pushing it between the wire frames so that a firm smooth opening is defined by the wire frames into which refuse may be conveniently moved.

1 Claim, 3 Drawing Figures

REFUSE COLLECTION DEVICE

BACKGROUND OF THE INVENTION (1) Field of the Invention

This invention relates to refuse collection devices in which plastic bags or the like are held on handles or the like so that refuse can be moved thereinto.

(2) Description of the Prior Art

Several devices have been patented which will hold a bag with the open end of the same in open position. See for example U.S. Pat. No. 3,754,785 wherein a clamping arm moves relative to a handle to clamp a portion of a bag against a frame.

U.S. Pat. No. 3,757,737 positions a flexible material loop in a bag and has prongs or hooks which impale portions of the bag.

U.S. Pat. No. 3,677,596 positions a wire frame in a bag opening and moves a retaining frame thereagainst and U.S. Pat. No. 4,012,067 has a bag supporting frame with a clamp on a handle of the frame engagable with the bag when folded thereover.

The present invention discloses a pair of wire frames respectively mounted on an elongated handle and a sleeve slidable on the handle with the frames extending outwardly at right angles to the plane of the handle and sleeve so that the open end of a disposable bag, such as one made of plastic film, can be positioned thereover, the frames moved apart to hold the bag and the bag then pushed through the frames and beneath the handle and the sleeve to position the outermost portions of the wire frames sufficiently within the bag to form spaced upper and lower straight edges holding the bag so that refuse may be conveniently moved thereinto.

SUMMARY OF THE INVENTION

A refuse collection device utilizes a pair of wire frames which define rectangular shapes on vertically spaced horizontal planes, one of the shapes being affixed to an elongated handle and the other to a sleeve slidable thereon. Catch means is provided for holding the sleeve in a position wherein the wire frame thereon is spaced with respect to the wire frame on the handle and where a disposable plastic film bag positioned over the wire frames will be held in open relation. A paddle-like removable extension of the elongated handle has disposable cardboard sections secured thereto and may be removed from the handle and used to push refuse, such as dog droppings or the like, into the bag being held in open position by the refuse collection device.

DESCRIPTION OF THE PREFERRED EMBODIMENT

Figure 1:
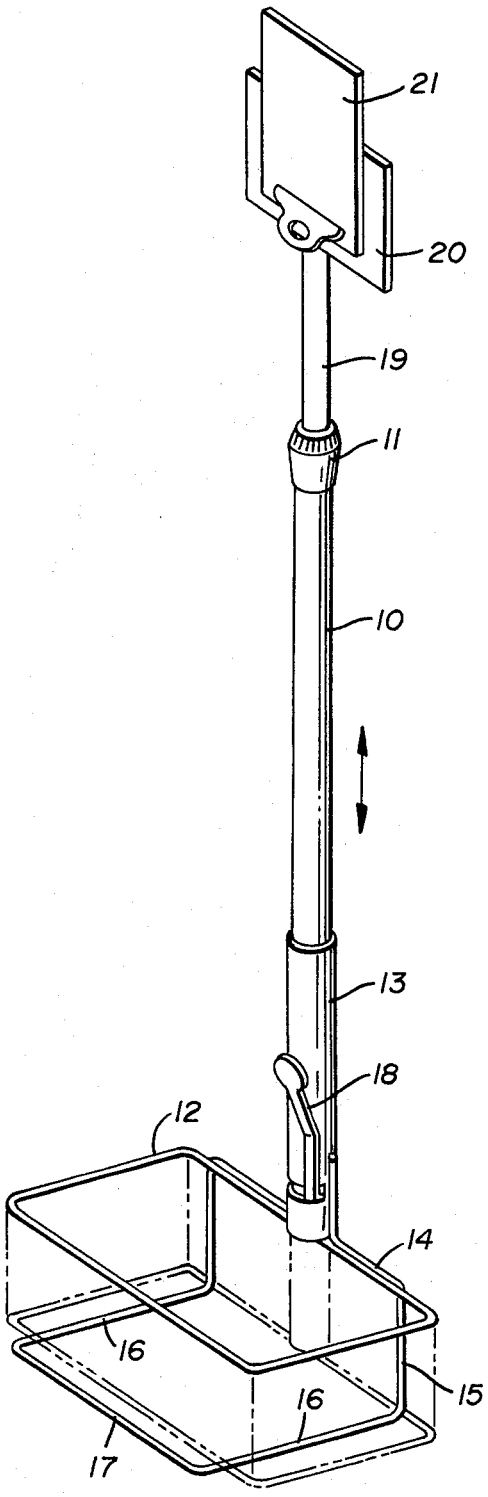
FIG. 1 is a perspective view of the refuse collection device with broken lines indicating an alternate position of one of the wire frames of the device.

By referring to the drawings and FIG. 1 in particular it will be seen that a refuse collection device has been illustrated which comprises an elongated handle 10 having a resilient apertured upper end piece 11 and a rectangular horizontally disposed wire frame 12 attached to its lower end. The wire frame 12 is preferably attached to the elongated handle 10 at one of its longitudinal sides and extends outwardly therefrom at right angles thereto. A sleeve 13 is slidably positioned on the lower portion of the elongated handle 10 and a second rectangular wire frame 14 is secured to the lower end of the sleeve 13. The second rectangular wire frame 14 has an upper horizontal longitudinal side where it is attached to the sleeve 13 with the outer ends of that side being downturned as at 15 and then outturned as at 16 with the opposite or outer portion 17 of the second rectangular wire frame positioned on the same vertical plane as the outer portion of the rectangular frame 12 heretofore referred to.

Still referring to FIG. 1 of the drawings, it will be observed that the rectangular wire frames 12 and 14 are slightly different in overall rectangular shape, the lower portions 16 and 17 of the second rectangular wire frame 14 being spaced inwardly of the respective end portions of the rectangular wire frame 12 so that when the elongated handle 10 is moved relative to the sleeve 13 the rectangular wire frames 12 and 14 may be positioned directly on one another as shown in the solid and broken lines in FIG. 1 or positioned in spaced vertical relation as shown in the solid lines in FIG. 1 of the drawings. A catch having a lever handle 18 is positioned on the inner surface of the sleeve 13 for frictional engagement with the exterior of the elongated handle 10 and is releasable by moving the lever handle 18 toward the sleeve 13 as will occur to those skilled in the art. The upper end of the elongated handle 10 telescopically receives a secondary handle 19 which has a paddle 20 on its uppermost end and a pad of removable disposable sections of cardboard 21 or the like. The secondary handle 19 upon being removed from the elongated handle 10 can be conveniently used as a paddle to move refuse into a plastic film bag held by the refuse collection device.

Figure 2:
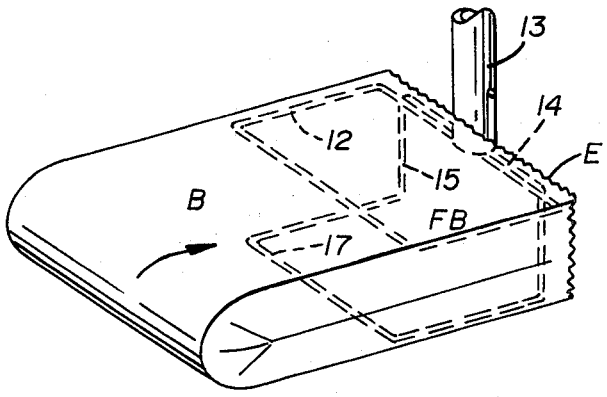
FIG. 2 is a perspective view of a portion of the device of FIG. 1 showing a plastic film bag positioned over the wire frames of the device and the same moved apart.

By referring to FIG. 2 of the drawings, a plastic film bag B will be seen in opened position with its open end E positioned over the rectangular wire frames 12 and 14 which are then moved vertically, as hereinbefore described, and secured in spaced relation so that the plastic film bag B is held in stretched open position.

Figure 3:
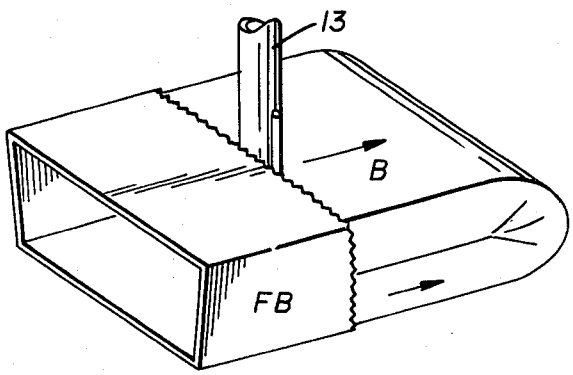
FIG. 3 is a perspective view of the device of FIGS. 1 and 2 showing the plastic film bag positioned thereon as in FIG. 2 and pushed through the area of the wire frames to turn the bag inside out and thus position the wire frames in spaced vertical straight edge relation holding the open end of the bag in smooth spaced vertical lines.

In FIG. 3 of the drawings, the plastic film bag B has been pushed through the space between the spaced rectangular wire frames 12 and 14 beneath the sleeve 13 so that the bag is turned inside out and the portion thereof engaged over the wire frames 12 and 14 forms a cuff which securely holds the plastic film bag B on the refuse collection device. It will be observed that the outermost portions of the rectangular wire frames 12 and 14 thus shape the open end of the bag and form spaced vertical smooth surfaces which facilitate the movement of refuse into the bag. When refuse has been deposited into the bag, the catch 18 may be released, the frames moved toward one another a short distance, and the folded end of the bag B, which is indicated by the letters FB in FIG. 3, moved away from the frame where it will provide sufficient material to be gathered together and secured with the usual wire tie or the like.

Although but one embodiment of the present invention has been illustrated and described, it will be apparent to those skilled in the art that various changes and modifications may be made therein without departing from the spirit of the invention and having thus described my invention.

What I claim is:

1. A refuse collection device comprising an elongated vertical handle, a sleeve movably mounted on said handle, vertically spaced horizontally positioned rectangular bag entering members on said handle and sleeve respectively and arranged for vertical movement toward and away from one another when said sleeve is moved relative to said handle, said bag entering member on said sleeve being vertically offset below said sleeve, first portions of said bag entering members extending from said handle and sleeve respectively in oppositely disposed horizontal right angles to said sleeve, the intermediate portions of said rectangular bag entering members being positioned at vertical right angles to said first horizontal portions whereby the remaining portions of said bag entering member on said sleeve are generally offset with respect to the plane of said bag entering member on said handle, said bag entering members adapted to enter and hold an open ended bag positioned thereover and hold and tension said bag in open end condition when moved apart vertically, a catch member on said sleeve selectively engagable with said handle whereby movement of said sleeve relative to said handle moves said bag entering members relative to one another so as to expand said open ended bag and hold the same on said members and permit said bag to be turned inside out so that a peripheral area of said bag is positioned around the opening thereof in folded relation over portions of said bag entering members.

* * * * *